United States Patent [19]

Gerstle et al.

[11] Patent Number: 4,889,781

[45] Date of Patent: Dec. 26, 1989

[54] PROCESS AND APPARATUS FOR PRODUCING A BLACK MATRIX LAYER

[75] Inventors: Volker Gerstle, Lorch; Gerhard Mauz, Kongen, both of Fed. Rep. of Germany

[73] Assignee: Nokia Graetz, Pforzheim, Fed. Rep. of Germany

[21] Appl. No.: 196,855

[22] Filed: May 19, 1988

Related U.S. Application Data

[63] Continuation of Ser. No. 913,118, Sep. 29, 1986, abandoned.

[30] Foreign Application Priority Data

Sep. 27, 1985 [DE] Fed. Rep. of Germany ..... 3534414

[51] Int. Cl.[4] ..... G03C 5/24

[52] U.S. Cl. ..... 430/25; 430/29; 430/325

[58] Field of Search ..... 430/23, 25, 29, 325, 430/330, 270, 909, 326, 331

[56] References Cited

U.S. PATENT DOCUMENTS 4,332,874 6/1972 Hayashi et al. ..... 430/28

FOREIGN PATENT DOCUMENTS 52-58374 5/1977 Japan ..... 430/330
57-152129 9/1982 Japan ..... 430/325
58-17443 2/1983 Japan ..... 430/325
60-230337 11/1985 Japan .

*Primary Examiner*—Thurman K. Page
*Attorney, Agent, or Firm*—Peter C. Van Der Sluys

[57] ABSTRACT

During the formation of a black-matrix layer on the inside surface of a faceplate of a color picture tube, the development of the photoresist coating takes place in an atmosphere with a relative humidity of between about 80–100% and at a temperature of between about 30°–50° C.

7 Claims, 1 Drawing Sheet

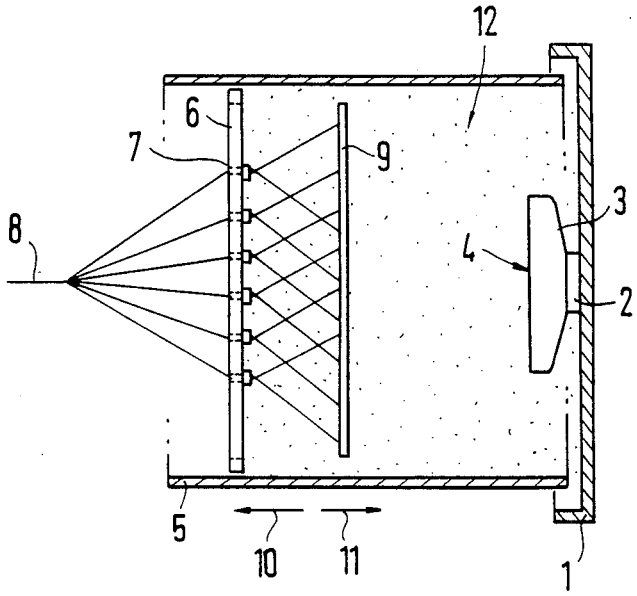
12
6
7
9
3
8
4
2
5
10
11
1

PROCESS AND APPARATUS FOR PRODUCING A BLACK MATRIX LAYER

This is a continuation of co-pending application Ser. No. 913,118, filed on Sept. 29, 1986, now abandoned.

BACKGROUND OF THE INVENTION

The present invention relates to a process for producing a black-matrix layer between the phosphor areas on the inside surface of a faceplate of a color picture tube and to apparatus for carrying out the process.

One such process is known from European Patent 77,976. In the method disclosed therein, a plurality of nozzles is used to spray water on the inside surface of a faceplate in order to develop the photoresist coating. It has been determined, however, that if the photoresist coating is developed in this manner, the reactions are uneven. These uneven reactions occur because the water droplets do not impinge on the photoresist coating at the same time. Another relevant process is disclosed in DE-OS 34 00 225.1.

SUMMARY OF THE INVENTION

It is an object of the invention to provide a process for producing a black-matrix layer by which an even reaction is achieved during the development of the photoresist coating. It is a further object of the invention to provide an apparatus for carrying out the method.

A process in accordance with the present invention for achieving the foregoing object comprises coating the inside surface of the faceplate of a picture tube with a photoresist, exposing certain portions of this photoresist coating to light and developing the exposed portions with water during which development, the photoresist coating is exposed to an atmosphere having a relative humidity of 80–100% and a temperature of 30°–50° C., and most preferably about 90% relative humidity and a temperature of about 40° C. Thereafter, the unexposed portions of the photoresist coating are removed and the entire inside surface of the faceplate is provided with a black-matrix layer, which is formed from a graphite suspension. Then, those portions of the black-matrix layer are removed where the phosphor areas are to be formed.

The invention further contemplates apparatus useful in carrying out the process of this invention. This apparatus is configured to provide the necessary humidity and temperature to enable the proper development of the photoresist coating. In a preferred embodiment, the apparatus includes a housing having therein a baffle plate positioned between a faceplate mounted on a base plate and a nozzle plate. The nozzle plate contains a plurality of nozzles connected to a temperature controlled water supply. The controlled temperature water exits through these nozzles and impacts with the baffle plate in a manner such that the water is atomized and a relatively high humidity atmosphere is created in the housing, preferably between about 80–100% relative humidity, at a temperature of between about 30°–50° C.

Other objects and advantages will become apparent from the following specification taken in connection with the accompanying drawing.

BRIEF DESCRIPTION OF THE DRAWING

The invention will now be described with the help of an embodiment. The FIGURE of the drawing represents a schematic section of the apparatus for producing a black-matrix layer.

DETAILED DESCRIPTION

In an embodiment of the process of this invention, a faceplate of a color picture tube is initially cleaned by usual techniques with hydrofluoric acid. Thereafter, the inside surface of the faceplate coated with a photoresist consisting of a water-soluble polymeric substance (e.g., polyvinyl alcohol) and a component sensitized with sodium dichromate. The coating is usually applied with the faceplate being rotated in order to produce a uniform coating of photoresist on the surface of the faceplate. This coating is dried, for example, by infrared radiation. Through a shadow mask, the photoresist coating is then exposed to light and hardened in those areas where phosphor for the phosphor area will be deposited later.

After the light exposure, the photoresist coating is developed by being subjected to an atmosphere having a relative humidity of about 80 to 100% and a temperature of 30° to 50° C. Preferably, the relative humidity is 90% and the temperature 40° C. The exposure time in this atmosphere is, e.g., 20 seconds.

Next, all unexposed areas of the photoresist coating are washed out and the entire inside surface of the faceplate is coated with a black matrix layer formed from a graphite suspension. After drying of the blackening layer and removal of the remains of the photoresist coating together with the overlying blackening layer, the phosphors for three colors are deposited successively in the free areas in the usual manner.

The method described ensures uniform development of all exposed areas of the photoresist coating. This results from the simultaneous presence of the high humidity everywhere on the photoresist coating during the development stage of the process. Thus, an even reaction takes place which results in a uniform development of the exposed areas. In continuous production, a uniform development of the photoresist coating in each faceplate is achieved by this process.

Of the entire production line for producing a black-matrix layer, only the apparatus for developing the photoresist coating is shown in the FIGURE. The preceding and following stations are not shown. The apparatus has a base plate 1 on which the faceplate 3 is mounted via a holding device 2. The inside surface 4 of the faceplate 3 faces the inside of the housing 5. In the housing 5, there is a nozzle plate 6 with a plurality of nozzles 7. The nozzles 7 have a connection 8 to a water supply for temperature controlled water. Between the faceplate 3 and the nozzle plate 6, a baffle plate 9 is located in such a way as to be hit by the water jets of the nozzles 7. The water is thus atomized and an atmosphere 12 is created with a relatively high humidity of about 80–100%, preferably about 90%, and a temperature of about 30° to 50° C., preferably about 40° C. After the photoresist coating on the faceplate 3 has been exposed to this atmosphere for about 20 seconds, the water supply is cut off and the housing 5 is moved in such a manner (arrow 10) that the base plate 1 with the faceplate 3 can be removed. After the insertion of a new base plate with a new faceplate, the housing is closed again (arrow 11) and an atmosphere with a relatively high humidity is again produced.

The housing can also be stationary; in that case, it has a movable cover in the area which is in contact with the base plate.

We claim:

1. A process for producing a black-matrix layer between phosphor areas on an inside surface of a faceplate of a color picture tube, comprising the steps of:

coating the inside surface of the faceplate with a photoresist;

exposing certain portions of this photoresist coating to light;

developing the light-exposed portions by subjecting the photoresist coating to water only in the form of water vapor having a relative humidity of about 80–100 percent and a temperature of about 30°–50° C.;

removing the unexposed portions of the photoresist coating;

providing the entire inside surface of the faceplate with a black-matrix layer formed from a graphite suspension; and removing those portions of the black-matrix layer where the phosphor areas are to be formed, whereby the simultaneous presence of the high humidity over the surface of the photoresist coating during development insures a uniform development of all exposed areas of the photoresist coating.

2. A method as claimed in claim 1, wherein the photoresist coating is subjected to a relative humidity of about 90% and a temperature of about 40° C.

3. A method as claimed in claim 1, wherein the photoresist is a water-soluble polymeric material.

4. A method as described in claim 3, wherein the photoresist comprises polyvinyl alcohol.

5. A method as claimed in claim 1, wherein the atmosphere having a relative humidity of about 80–100% is created by atomizing water.

6. A process for developing a black-matrix layer between phosphor areas on an inside surface of a faceplate of a color picture tube, comprising the steps of:

coating the inside surface of the faceplate with a photoresist in the form of a water-soluble polymeric material;

exposing certain portions of this photoresist coating to light;

developing the light-exposed portions by subjecting the photoresist coating to water only in the form of water vapor having a relative humidity of about 80–100 percent and a temperature of about 30°–50° C.;

removing the unexposed portions of the photoresist coating;

providing the entire inside surface of the faceplate with a black-matrix layer formed from a graphite suspension; and removing those portions of the black-matrix layer where the phosphor areas are to be formed, whereby the simultaneous application of water vapor to the surface of the photoresist provides a uniform development of the exposed areas of the photoresist.

7. A process for producing a black-matrix layer between phosphor areas on an inside surface of a faceplate of a color picture tube, comprising the steps of:

coating the inside surface of the faceplate with a photoresist;

exposing certain portions of this photoresist coating to light;

developing the light-exposed portions by subjecting the photoresist coating to an atmosphere containing developer in the form of water vapor having a relative humidity of about 80–100 percent created by atomizing water, said atomizing being performed by providing water at a temperature of about 30°–50° C., and spraying said water against a baffle, whereby the warm water striking the baffle is atomized and the photoresist is protected from direct contact with water droplets;

removing the the unexposed portions of the photoresist coating;

providing the entire inside surface of the faceplate with a black-matrix layer formed from a graphite suspension; and removing those portions of the black-matrix layer where the phosphor areas are to be formed, whereby the simultaneous presence of the high humidity over the surface of the photoresist coating during development assures a a uniform development of all exposed areas of the photoresist coating.

* * * * *